US009158263B2

(12) United States Patent
Tomino

(10) Patent No.: US 9,158,263 B2
(45) Date of Patent: Oct. 13, 2015

(54) COOLING DEVICE AND IMAGE FORMING APPARATUS

(71) Applicant: KONICA MINOLTA, INC., Tokyo (JP)

(72) Inventor: Toshiaki Tomino, Hachioji (JP)

(73) Assignee: KONICA MINOLTA, INC. (JP)

( * ) Notice: Subject to any disclaimer, the term of this patent is extended or adjusted under 35 U.S.C. 154(b) by 0 days.

(21) Appl. No.: 14/227,377

(22) Filed: Mar. 27, 2014

(65) Prior Publication Data

US 2014/0308057 A1 Oct. 16, 2014

(30) Foreign Application Priority Data

Apr. 12, 2013 (JP) ..... 2013-083681

(51) Int. Cl.
*G03G 15/20* (2006.01)
*G03G 15/00* (2006.01)

(52) U.S. Cl.
CPC ..... *G03G 15/6573* (2013.01); *G03G 15/2017* (2013.01)

(58) Field of Classification Search
CPC ..... G03G 15/6573; G03G 15/2017
See application file for complete search history.

(56) References Cited

U.S. PATENT DOCUMENTS

2009/0103959 A1* 4/2009 Koyama et al. ..... 399/341
2012/0224898 A1* 9/2012 Amita et al. ..... 399/341
2012/0315069 A1* 12/2012 Ikeda et al. ..... 399/341
2013/0177332 A1* 7/2013 Saito ..... 399/92

FOREIGN PATENT DOCUMENTS

JP 2012198502 A 10/2012

* cited by examiner

*Primary Examiner* — Sandra Brase
(74) *Attorney, Agent, or Firm* — Cantor Colburn LLP

(57) ABSTRACT

A cooling device includes a conveying portion configured to convey a sheet while holding the sheet between a first belt and a second belt; a stretching roller configured to drive the first belt inside the first belt; and a cooling portion having a flow-passage forming portion for forming a flow passage of a cooling medium and configured to cool the sheet through the first belt. Moreover, the cooling device includes a press roller provided inside the second belt and facing the flow-passage forming portion through the second belt and the first belt; and a contacting/separating portion configured to have the second belt contact with/separate from the cooling portion through the first belt by moving the press roller. The stretching roller has a lower end portion located below a cooling surface of the cooling portion.

9 Claims, 13 Drawing Sheets

COOLING DEVICE AND IMAGE FORMING APPARATUS

CROSS REFERENCES TO RELATED APPLICATIONS

The present invention contains subject matter related to Japanese Patent Applications JP2013-083681, filed in the Japanese Patent Office on Apr. 12, 2013, respectively, the entire contents of which being incorporated herein by reference.

BACKGROUND OF THE INVENTION

1. Field of the Invention

The present invention relates to a cooling device for cooling a sheet heated by a fixing device and an image forming apparatus provided with the cooling device.

2. Description of the Related Art

A cooling device for cooling a sheet heated by a fixing device and an image forming apparatus provided with the cooling device have been known.

Patent Literature 1 discloses an image forming apparatus provided with a heat exchanging device. This heat exchanging device includes a cooling belt stretched across a plurality of rollers, a conveying belt for conveying a sheet while holding the sheet between the cooling belt and the conveying belt, and a cooling plate disposed inside the cooling belt and having a flow passage through which a cooling liquid flows formed therein. The sheet conveyed by the conveying belt is brought into contact with a lower surface (cooling surface) of the cooling plate through the cooling belt, whereby heat of the sheet is transferred to the cooling liquid having flowed into the flow passage, and the sheet is cooled. In this heat exchanging device and the image forming apparatus, in order to further improve a contact state between the sheet and the cooling belt and a contact state between the cooling belt and the cooling plate, press rollers applying a force onto the cooling surface of the cooling plate from inside the conveying belt are provided at appropriate positions.

CITATION LIST

Patent Literature

Patent Literature 1: Japanese Patent Laid-Open No. 2012-198502

SUMMARY OF THE INVENTION

Problems to be Solved by the Invention

However, with the configuration described in Patent Literature 1, even if pressing by the press roller is released, contact between the cooling plate and the cooling belt is not released. If the cooling plate and the cooling belt are left in the contact state for a long time, the cooling belt is fixed to the cooling plate, which makes the cooling belt unable to be driven. Moreover, even if the cooling belt is removed from the cooling plate, the cooling belt may be wrinkled or broken, which is a problem. In order to release the contact between the cooling plate and an inner peripheral surface of the cooling belt, a tension having been applied to the cooling belt and the conveying belt should be released, belt nip portions of the cooling belt and the conveying belt should be all released so that the cooling belt and the conveying belt are loosened, and its method becomes complicated.

From the above circumstances, a method for easily separating the cooling belt from the cooling surface of the cooling device is in demand.

Means for Solving the Problems

A cooling device according to an aspect of the present invention is a cooling device used for an image forming apparatus and includes a conveying portion, a stretching roller, a cooling portion, a press roller, and a contacting/separating portion.

The conveying portion has a first belt and a second belt which are endless and face each other, and conveys a sheet while holding the sheet between the first belt and the second belt.

The stretching roller is provided inside the first belt and drives the first belt.

The cooling portion has a flow-passage forming portion for forming a flow passage through which a cooling medium flows and cools the sheet through the first belt.

The press roller is provided inside the second belt and faces the flow-passage forming portion through the second belt and the first belt.

The contacting/separating portion has the second belt contact with/separate from the cooling portion through the first belt by moving the press roller.

The stretching roller is arranged so that a tangent on a lower side among the tangents of a sectional shape in a horizontal direction is located below a cooling surface contacting with the first belt of the cooling portion.

Moreover, the image forming apparatus of an aspect of the present invention includes the above described cooling device.

DESCRIPTION OF THE PREFERRED EMBODIMENTS

First Embodiment

Figure 1:
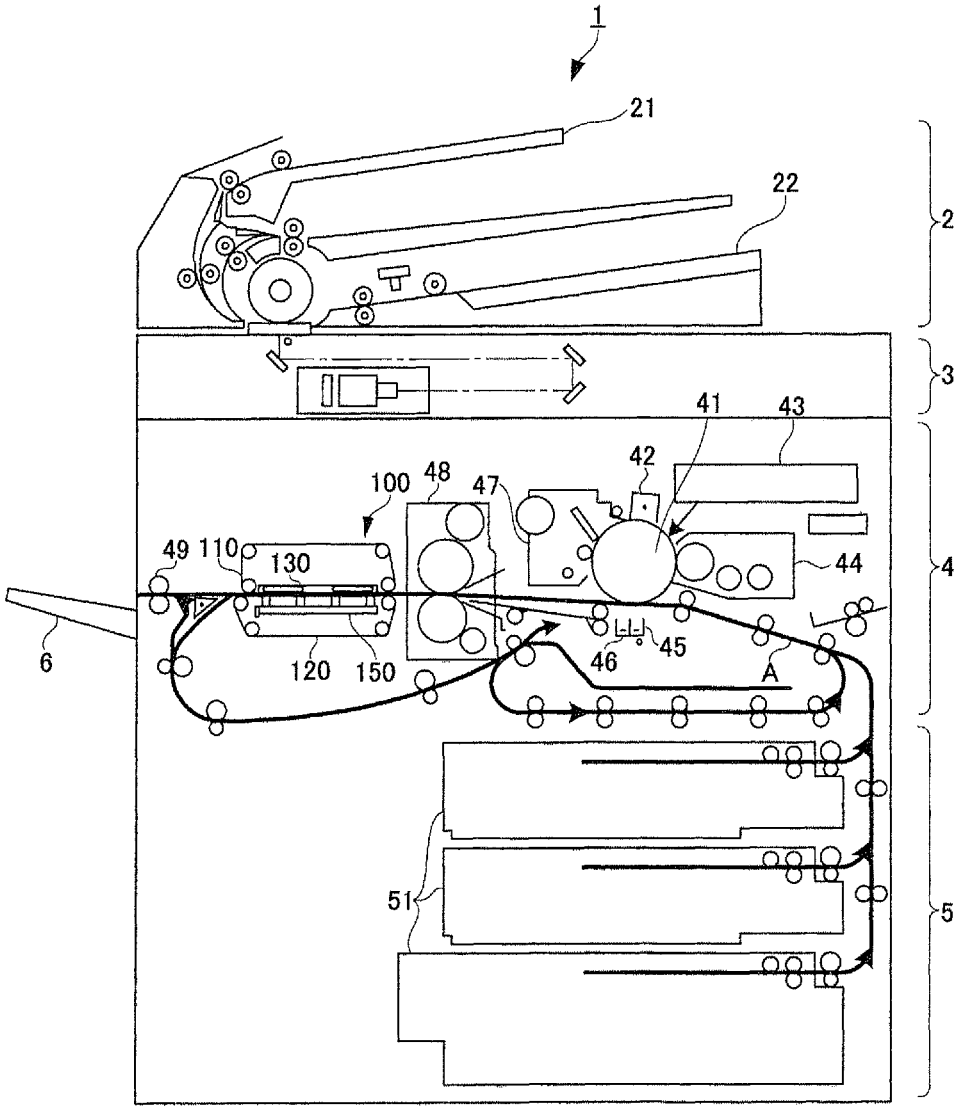
FIG. 1 is an outline diagram illustrating an entire configuration of an image forming apparatus according to a first embodiment of the present invention.

A first embodiment of the present invention will be described below by referring to FIGS. 1 to 7. In each figure, common members are given the same reference numerals.

[Configuration of Image Forming Apparatus]

FIG. 1 illustrates an outline sectional view of an image forming apparatus 1 according to the first embodiment of the present invention. The image forming apparatus 1 includes functions of a copying machine, a printer, a facsimile machine and the like and forms a monochromic image on a sheet by an electrophotography method.

The image forming apparatus 1 includes a document conveying portion 2, a document reading portion 3, an image forming portion 4, a sheet feeding cassette portion 5, and a sheet ejection tray 6. In the image forming apparatus 1, a sheet conveying path A from the sheet feeding cassette portion 5 to the sheet ejection tray 6 through the image forming portion 4 is formed by various rollers, a guide plate, a conveying belt and the like provided at predetermined positions. Moreover, the image forming apparatus 1 can be connected to an external device such as a personal computer (see FIG. 5), for example, and obtains image data from the external device.

The document conveying portion 2 is to convey a document to the document reading portion 3 for continuous reading of the document and has a document feeding tray 21 and a document ejection tray 22. The document conveying portion 2 conveys the document set in the document feeding tray 21 to a predetermined reading position of the document reading portion 3. Moreover, after the document reading portion 3 reads the document having been conveyed to the predetermined reading position, the document conveying portion 2 conveys this document to the document ejection tray 22.

The document reading portion 3 optically reads a document image, converts information of the document image to an analog electric signal and further converts the analog electric signal to a digital signal. Then, the document reading portion 3 outputs the converted digital signal as image data to a control portion 200 which will be described later.

The image forming portion 4 has a drum-shaped photoreceptor 41, and a charging portion 42, an image writing portion 43, a developing portion 44, a transfer portion 45, a separation portion 46, and a cleaning portion 47 which are provided around the photoreceptor 41 as an image forming function portion. Moreover, the image forming portion 4 has a fixation portion 48, a cooling device 100, and a sheet ejection roller 49. In the image forming portion 4, the image forming function portion including the photoreceptor 41 and the above described respective portions provided around the photoreceptor 41, the fixation portion 48, the cooling device 100, and the sheet ejection roller 49 are arranged in this order from an upstream side of the sheet conveying path A.

The charging portion 42 applies a predetermined voltage to the photoreceptor 41 and uniformly charges the surface of the photoreceptor 41. The image writing portion 43 obtains image data subjected to predetermined image processing from the control portion 200 which will be described later, emits a laser beam on the basis of the obtained image data to form an electrostatic latent image on the photoreceptor.

The developing portion 44 reversal-develops the electrostatic latent image formed on the photoreceptor 41 to create a toner image on the photoreceptor 41. The sheet is fed so as to synchronize with rotation of the photoreceptor 41 on which the toner image is created, and the transfer portion 45 applies a predetermined voltage from a back surface side of the conveying belt for conveying the sheet so as to transfer the toner image formed on the photoreceptor 41 to the sheet.

The separation portion 46 removes electricity of the sheet to which the toner image has been transferred to thereby separate the sheet from the photoreceptor 41. Subsequently, the sheet to which the toner image has been transferred is conveyed to the fixation portion 48.

The fixation portion 48 heats the sheet so as to melt the toner of the transferred toner image and pressurizes the sheet to fix the toner image on the sheet. The sheet is cooled by the cooling device 100, conveyed by the sheet ejection roller 49 and placed on the sheet ejection tray 6 or if an image is to be formed on the both surfaces, the sheet is fed again to the image forming function portion.

The sheet feeding cassette portion 5 has a plurality of sheet feeding cassettes 51 corresponding to various types of sheet and feeds the predetermined sheets accommodated in each of the sheet feeding cassettes 51 one by one to the image forming portion 4 along the sheet conveying path A.

[Configuration of Cooling Device 100]

Figure 2:
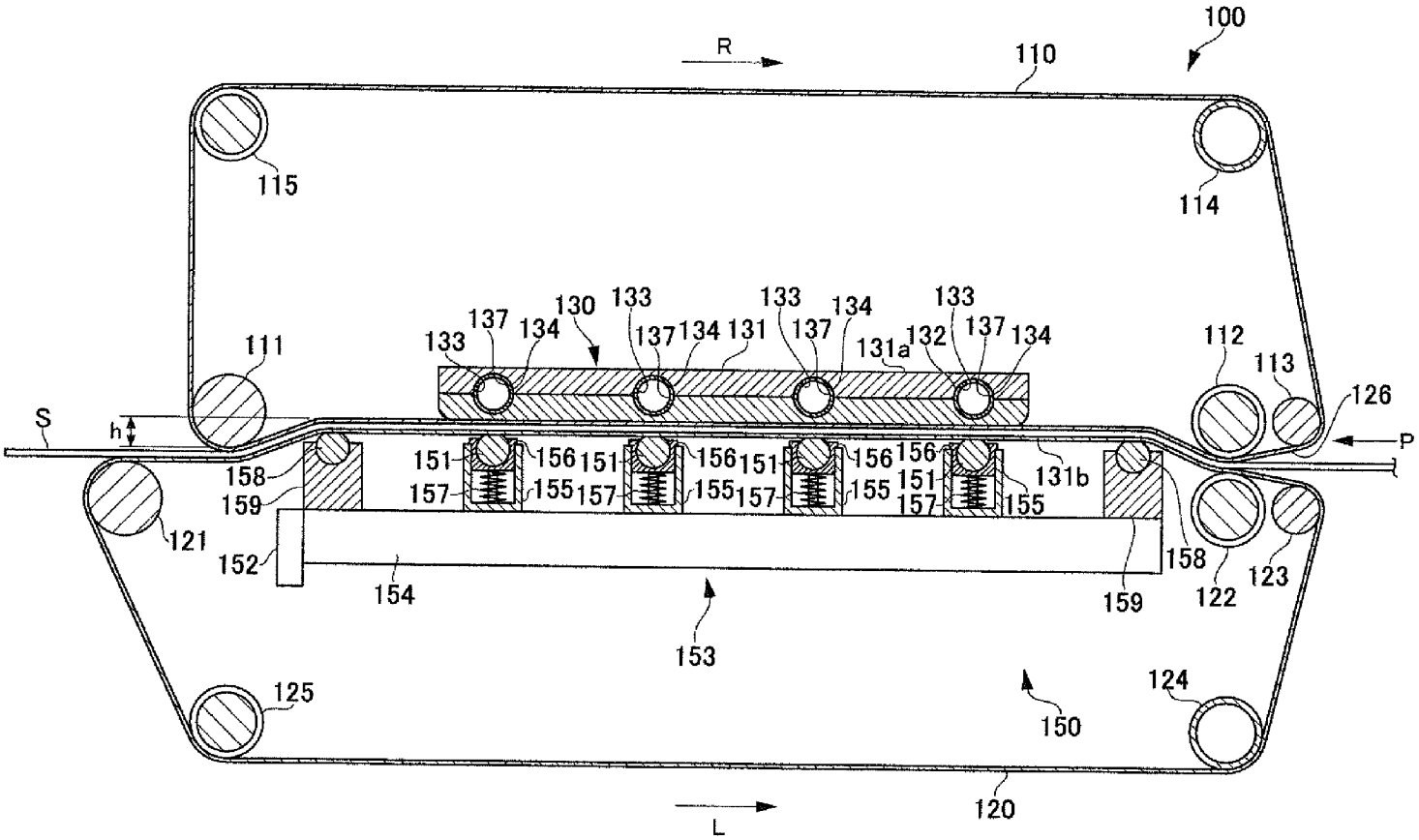
FIG. 2 is a sectional view of an essential part (pressed state) illustrating a cross section of a cooling device of the image forming apparatus in FIG. 1 along a conveying direction of a sheet.
Figure 3:
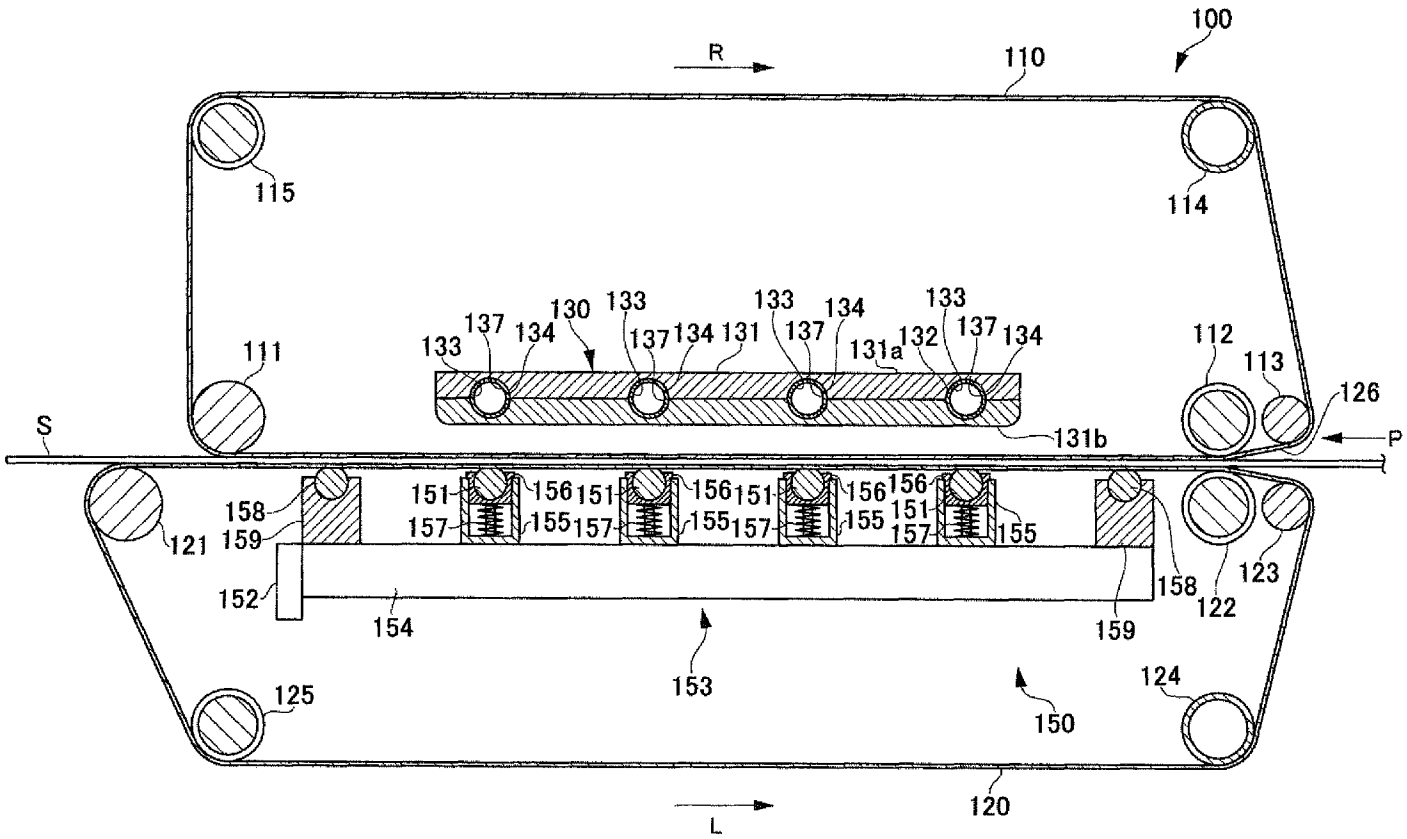
FIG. 3 is a sectional view of the essential part (released state) illustrating a cross section of the cooling device of the image forming apparatus in FIG. 1 along the conveying direction of the sheet.
Figure 4:
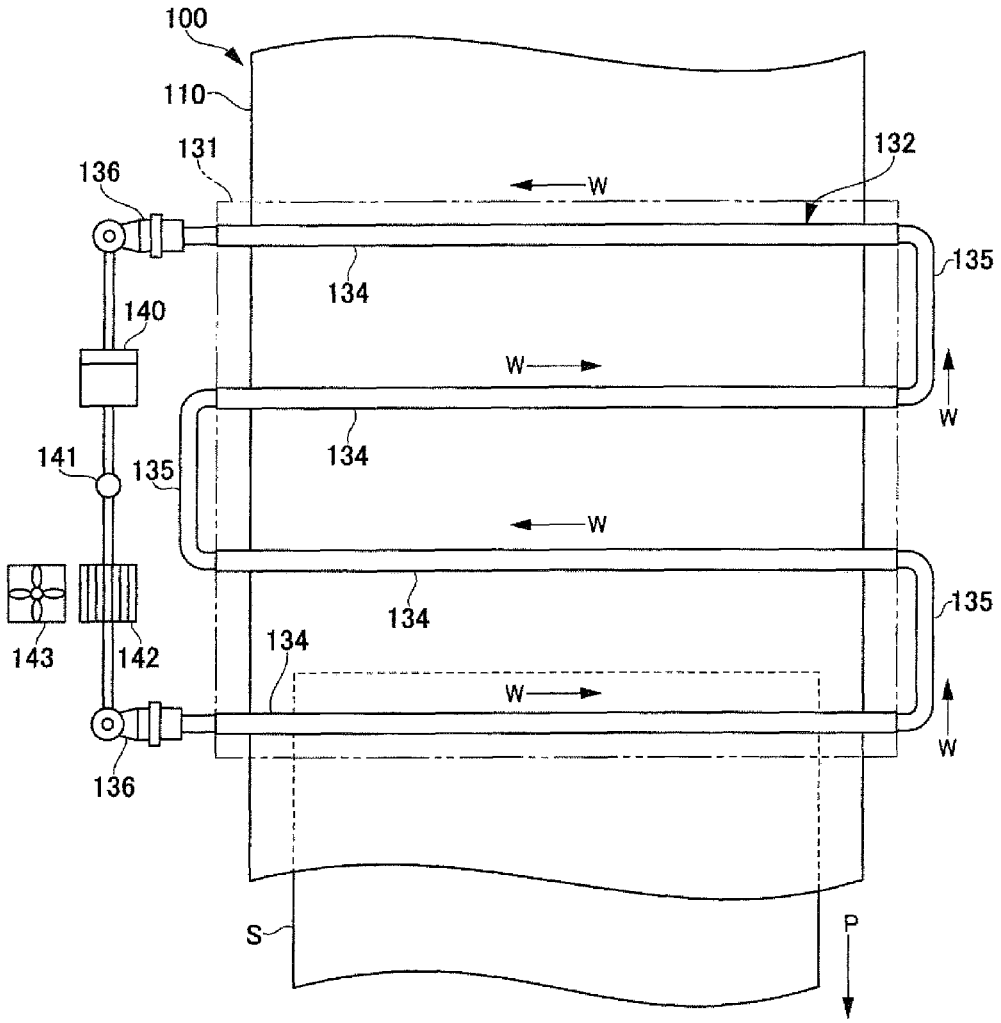
FIG. 4 is a top view of the essential part illustrating the cooling device of the image forming apparatus in FIG. 1 when seen from above.

Subsequently, the cooling device 100 of the image forming apparatus 1 will be described by referring to FIGS. 2 to 4. FIG. 2 is a sectional view of an essential part illustrating a cross section of the cooling device 100 in a pressed state along the sheet conveying direction. FIG. 3 is a sectional view of the essential part illustrating the cooling device 100 in a pressure released state (hereinafter referred to as a "released state") along the sheet conveying direction. FIG. 4 is a top view of the essential part of this cooling device 100 when seen from above. In FIGS. 2 to 4, reference character S indicates a sheet, and an arrow P indicates a sheet conveying direction.

As illustrated in FIGS. 2 to 4, the cooling device 100 has a cooling belt 110, a conveying belt 120, a cooling portion 130, and a pressing unit 150.

The cooling belt 110 is an endless belt stretched across a plurality of rollers extended in a direction orthogonal to the sheet conveying direction on a horizontal plane. In the present embodiment, rollers across which the cooling belt 110 is stretched (stretching rollers) are an upper driving roller 111, a first upper driven roller 112, an upper introduction roller 113, an upper steering roller 114, and a second upper driven roller 115.

The upper driving roller 111 is provided on a downstream side in the sheet conveying direction. Moreover, the upper driving roller 111 is connected to a rotation mechanism, not shown. The first upper driven roller 112 is provided on an upstream side in the sheet conveying direction from the upper driving roller 111 at a height position similar to the upper driving roller 111. The upper driving roller 111 and the first upper driven roller 112 are arranged so that a tangent on a lower side among the tangents of the sectional shape in the horizontal direction is located slightly below a lower surface (cooling surface) in contact with the cooling belt 110 of a cooling plate 131 in the cooling portion 130. Hereinafter, a contact point between the roller and the tangent on the lower side among the tangents of the sectional shape of the roller in the horizontal direction is described as a "lower end portion" and a contact point between the roller and the tangent on the upper side as an "upper end portion". In the present embodiment, a position of a lower surface of a lower member 131*b* of the cooling plate 131 and a position of the lower end portions of the upper driving roller 111 and the first upper driven roller 112 are made different by a height h in the vertical direction. In FIGS. 2 and 3, a difference between the position of the lower surface of the lower member 131*b* of the cooling plate 131 and the positions of the lower end portions of the upper driving roller 111 and the first upper driven roller 112 is expressed with an emphasis so that the difference can be easily understood. In an actual cooling device, the height h is in the order of several mm such as 3 mm, for example, and a contact surface between a sheet S and the cooling belt 110 is substantially horizontal.

The upper introduction roller 113 is provided on the upstream side in the sheet conveying direction from the first upper driven roller 112. The upper introduction roller 113 is arranged so that a lower end portion of the upper introduction roller 113 is located at a position higher than the lower end portion of the first upper driven roller 112. The upper steering roller 114 is provided above the first upper driven roller 112. The second upper driven roller 115 is provided above the upper driving roller 111 and at a height position similar to the upper steering roller 114. The cooling belt 110 is stretched across these rollers so as to form a substantially trapezoidal shape on a side view and rotates in an arrow R direction in FIG. 2 along with rotation of the upper driving roller 111.

The conveying belt 120 is an endless belt stretched across a plurality of rollers extending in a direction orthogonal to the sheet conveying direction on a horizontal plane and is provided below the cooling belt 110. In the present embodiment, rollers across which the conveying belt 120 is stretched (stretching rollers) area lower driving roller 121, a first lower driven roller 122, a lower introduction roller 123, a lower steering roller 124, and a second lower driven roller 125.

The lower driving roller 121 is provided on the downstream side in the sheet conveying direction. Moreover, the lower driving roller 121 is connected to a rotation mechanism, not shown. The first lower driven roller 122 is provided on the upstream side in the sheet conveying direction from the lower driving roller 121 at a height position similar to the lower driving roller 121. The lower introduction roller 123 is provided on the upstream side in the sheet conveying direction from the first lower driven roller 122. The lower introduction roller 123 is arranged so that an upper end portion of the lower introduction roller 123 is located at a position lower than an upper end portion of the first lower driven roller 122. The lower steering roller 124 is provided below the first lower driven roller 122. The second lower driven roller 125 is provided below the lower driving roller 121 and at a height position similar to the lower steering roller 124. The conveying belt 120 is stretched across these rollers so as to form a substantially trapezoidal shape on a side view and rotates in an arrow L direction in FIG. 2 along with rotation of the lower driving roller 121.

The cooling belt 110 and the conveying belt 120 are not in contact with each other in the vicinity of the upper introduction roller 113 and the lower introduction roller 123 and form an introduction port 126 for receiving the sheet having been conveyed from the upstream side of the conveying path A. Moreover, outer peripheral surfaces of the cooling belt 110 and the conveying belt 120 facing each other contact with the sheet in regions on the downstream side in the sheet conveying direction from the introduction port 126 and convey the sheet while holding it between the contact regions. As described above, the cooling belt 110 and the conveying belt 120 form a conveying portion for conveying the sheet.

The upper driving roller 111 is more preferably a roller with a one-way clutch. Only a rotation torque of the sheet in the conveying direction (arrow R direction) is adapted to be transmitted to the upper driving roller 111. As a result, when the inner peripheral surface of the conveying belt 120 is pressed by press rollers 151 and support rollers 158, the upper driving roller 111 rotates in a direction opposite to the sheet conveying direction (arrow R direction). During pressing, the cooling belt 110 in the vicinity of the second upper driven roller 115 and the upper driving roller 111 is pulled in the direction opposite to the sheet conveying direction, and a tension of the cooling belt 110 in this vicinity is locally raised. However, by rotation of the upper driving roller 111 in the opposite direction during pressing, a rise in the tension in the corresponding place of the cooling belt 110 is suppressed. Therefore, a uniform tension is applied to the whole peripheral length of the cooling belt 110. Thus, an excessive load is prevented from being applied to the second upper driven roller 115 or the upper driving roller 111.

If a roller with a one-way clutch is applied to the lower driving roller 121, a similar effect can be obtained, but application to the upper driving roller 111 has a higher effect.

The cooling portion 130 has, as illustrated in FIGS. 2 to 4, the cooling plate 131, a cooling pipe unit (flow-passage forming portion) 132, a tank 140 (see FIG. 4), a pump (medium supply portion) 141 (see FIG. 4), a radiator 142, and a fan 143 (see FIG. 4).

The cooling plate 131 is a flat plate-shaped member formed of metal with good heat conductivity or aluminum or copper, for example, and a plurality of fitting holes, or four fitting holes 133 in the present embodiment, to be fitted with the cooling pipe unit 132 are provided therein. The fitting holes 133 are formed in a direction orthogonal to the sheet conveying direction on the horizontal plane. The cooling plate 131 is formed by preparing two flat plate-shaped members, that is, an upper member 131*a* and a lower member 131*b* in which a groove having a semicircular shape is formed in one of the surfaces and by crimping the upper member 131*a* and the lower member 131*b* so that the grooves thereof face each other. Moreover, the fitting holes 133 are formed by the grooves facing each other. It may be so configured that an inner diameter of the fitting hole 133 is set slightly smaller than an outer diameter of a cooling pipe body 134 which will be described later of the cooling pipe unit 132, and uniform projections are provided at places where the grooves of the upper member 131*a* and the lower member 131*b* are formed. In this case, the projections bite into the cooling pipe body 134 during crimping of the upper member 131*a* and the lower member 131*b* to enable elimination of a gap between the cooling pipe body 134 and the fitting hole 133. Moreover, it may be so configured that a recess portion (not shown) recessed upward is formed on both end portions of the upper member 131*a* in the sheet conveying direction, a projecting portion (not shown) projecting upward is formed on both end portions of the lower member 131*b* in the sheet conveying direction, and the recess portion and the projecting portion are engaged with each other. Moreover, the cooling plate 131 may be formed by penetrating the fitting hole 133 in a flat plate-shaped side surface.

The cooling plate 131 is provided inside the cooling belt 110 and between the upper driving roller 111 and the first upper driven roller 112. The lower surface of the lower member 131*b* of the cooling plate 131 is in contact with an inner peripheral surface of the cooling belt 110 in a region where the outer peripheral surfaces of the cooling belt 110 and the conveying belt 120 are in contact with each other.

The cooling pipe unit 132 is a tubular member formed of metal with good heat conductivity or aluminum or copper, for example, and a flow passage 137 through which a cooling water flows is formed therein. The cooling pipe unit 132 has four cooling pipe bodies 134, three joining portions 135, and two connecting portions 136.

The joining portions 135 extend in the sheet conveying direction, both end portions of which are bent in a direction orthogonal to the sheet conveying direction on the horizontal plane and fixed to an end portion of the cooling pipe body 134. The joining portions 135 join the end portions of the adjacent cooling pipe bodies 134 to each other.

The connecting portions 136 are provided on the end portions on which the joining portions 135 of the cooling pipe bodies 134 are not fixed. In the cooling pipe bodies 134 joined by the joining portions 135, the connecting portion 136 provided on the cooling pipe body 134 arranged on the uppermost stream side in the sheet conveying direction connects the cooling pipe body 134 to the tank 140. Moreover, in the cooling pipe bodies 134 joined by the joining portions 135, the connecting portion 136 provided on the cooling pipe body 134 arranged on the lowermost stream side of the sheet conveying direction connects the cooling pipe body 134 to the radiator 142.

The tank 140 accommodates a cooling water indicating a specific example of a cooling medium. The pump 141, the driving of which being controlled by the control portion 200, supplies the cooling water from the tank 140 to the radiator 142 and circulates the cooling water in the cooling portion 130.

The fan 143 is arranged in the vicinity of an opening (not shown) for communicating the inside of the image forming apparatus 1 (hereinafter referred to as "inside the apparatus" in some cases) with the outside of the apparatus (see FIG. 12). The fan 143 has the outside air flow in from the opening and leads it to the radiator 142.

In the cooling device 100 configured as above, the pump 141 supplies the cooling water from the tank 140 to the cooling pipe unit 132 during image formation so that the cooling water flows from the downstream side to the upstream side in the sheet conveying direction through the flow passage 137 in the cooling pipe unit 132. Therefore, the cooling water supplied to the cooling pipe unit 132 first flows inside the cooling pipe body 134 arranged on the lowermost stream side of the sheet conveying direction and then, flows inside the first joining portion 135 and flows into the cooling pipe body 134 arranged on the second from the downstream side in the sheet conveying direction. Subsequently, the cooling water flows inside the second joining portion 135 joining the cooling pipe body 134 arranged on the second from the downstream side in the sheet conveying direction and the cooling pipe body 134 arranged on the third and inside the cooling pipe body 134 arranged on the third from the downstream side in the sheet conveying direction. Subsequently, the cooling water flows inside the third joining portion 135 joining the cooling pipe body 134 arranged on the third from the downstream aside in the sheet conveying direction and the cooling pipe body 134 arranged on the uppermost stream side and inside the cooling pipe body 134 arranged on the uppermost stream side. Then, the cooling water is discharged from the flow passage through the connecting portion 136 and accommodated in the tank 140.

As described above, the pump 141 supplies the cooling water to the cooling pipe unit 132 so that the cooling water flows inside the cooling pipe unit 132 from the downstream side to the upstream side in the sheet conveying direction. An arrow W in FIG. 4 indicates a flowing direction of the cooling water.

The pressing unit 150 is, as illustrated in FIGS. 2 and 3, provided inside the conveying belt 120 and between the lower driving roller 121 and the first lower driven roller 122. The pressing unit 150 presses the inner peripheral surface of the conveying belt 120 in a region where outer peripheral surfaces of the cooling belt 110 and the conveying belt 120 contact with each other.

Moreover, the pressing unit 150 has four press rollers 151 in contact with the conveying belt 120, a pressing base body 153 (contacting/separating portion) supporting the press rollers 151, and a pressing driving mechanism 152 moving the pressing base body 153 in a vertical direction. Moreover, the pressing unit 150 has two support rollers 158 for supporting the conveying belt 120 from the inner peripheral side to an upper direction. The two support rollers 158 are supported by the pressing base body 153.

The pressing base body 153 has a body portion 154, a guide portion 155, and a bearing portion 156. The body portion 154 is formed into a flat plate shape and on an upper surface thereof, the bearing portion 156 rotatably supporting the press roller 151, and the guide portion 155 for guiding movement in a vertical direction of the bearing portion 156 are provided. The bearing portion 156 is urged upward (to the cooling portion 130 side) by a coil spring 157 fixed to the guide portion 155. Moreover, on the upper surface of the pressing base body 153, a bearing portion 159 for rotatably supporting the support roller 158 is provided.

The pressing driving mechanism 152 includes a motor and a gear, not shown, the driving of which being controlled by the control portion 200, and moves the pressing base body 153 in the vertical direction. The control portion 200 executes pressing force adjusting processing during image formation. Specifically, the control portion 200 controls driving of the pressing driving mechanism 152 in accordance with a sheet thickness stored in advance and corresponding to the sheet feeding cassette 51 accommodating the sheets to be fed and moves the pressing base body 153 in the vertical direction. As a result, the pressing force onto the conveying belt 120 inputted by the press roller 151 is adjusted. For example, if an image is to be formed on a so-called cardboard, the pressing base body 153 is moved downward, and the pressing force of the press roller 151 is weakened. As a result, a load of the cooling belt 110 and the conveying belt 120 conveying the sheet while holding it between the contact regions is reduced. This pressing force adjusting processing is executed in accordance with an instruction of a user or at predetermined timing.

The press roller 151 is a substantially columnar member formed of an elastic body, that is, rubber or a resin, for example, and formed into a crown shape with an outer diameter at a center part larger than that on an end portion in a rotation shaft direction. The elastic body used for forming the press roller 151 is preferably an elastic body with hardness of 60 degrees or less. If the press roller 151 formed of the elastic body having the hardness of 60 degrees or less is used, the sheet being fed can be sufficiently brought into close contact with the cooling plate 131.

Each of the four press rollers 151 faces each cooling pipe body 134 of the cooling pipe unit 132 in the vertical direction through the conveying belt 120, the cooling belt 110, and the lower member 131*b*. The press roller 151 is in contact with the inner peripheral surface of the conveying belt 120 in the region where the outer peripheral surfaces of the cooling belt 110 and the conveying belt 120 contact with each other. Thus, the press roller 151 can press the sheet being conveyed to the vicinity of the cooling pipe body 134 of the cooling plate 131. As a result, the sheet can be cooled efficiently.

A length of the press roller 151 in a direction (axial direction) orthogonal to the sheet conveying direction on the horizontal plane is set longer than the length of the largest sheet conveyed into the cooling device 100 in the same direction. Moreover, a length of the press roller 151 in the direction (axial direction) orthogonal to the sheet conveying direction on the horizontal plane is set shorter than the length of the cooling plate 131 in the same direction.

The support roller 158 is arranged between the lower driving roller 121 and the first lower driven roller 122 and on the upstream side and the downstream side of the press roller 151 in the sheet conveying direction. An upper end portion of the support roller 158 is arranged so as to be substantially at the same height as the contact portion between the press roller 151 and the conveying belt 120 during pressing. That is, the cooling belt 110 and the conveying belt 120 are horizontally stretched between the support rollers 158 during pressing. As described above, the lower end portions of the upper driving roller 111 and the first upper driven roller 112 are located below the lower surface of the lower member 131*b* of the cooling plate 131. Thus, on the upstream side of the press roller 151 on the uppermost stream side in the sheet conveying direction (right end in the four press rollers 151 in FIG. 2) and on the downstream side of the press roller 151 on the lowermost stream side in the sheet conveying direction (left end in the four press rollers 151 in FIG. 2) during pressing, the cooling belt 110 hangs down. By arranging the support rollers 158 on the upstream side and the downstream side of the press roller 151 in the sheet conveying direction and on the outside of the lower surface of the cooling plate 131, the inner peripheral surface of the cooling belt 110 is brought into contact with the whole lower surface of the cooling plate 131 through the conveying belt 120.

During pressing, the upper end portions of the support rollers 158 are in contact with the inner peripheral surface of the conveying belt 120 in the region where the outer peripheral surfaces of the cooling belt 110 and the conveying belt 120 contact with each other. For the support rollers 158, a roller made of a member with high hardness (metal, for example) is used. If an elastic body is used for the roller used for pressing as the press roller 151, if a tension is varied during driving of the belt, the roller is elastically deformed, and the belt enters a wavy state (so-called rattling). Thus, by using the roller with high hardness for the support rollers 158, a distance from the upper surface of the pressing base body 153 to the upper end portions of the support rollers 158 is kept constant, and rattling of the belt caused by tension variation during driving of the belt when the elastic body is used can be prevented.

In the present embodiment, by means of pressing by the two support rollers 158 and the tensions of the cooling belt 110 and the conveying belt 120, the cooling belt 110 is brought into close contact with the lower surface of the lower member 131*b* of the cooling plate 131. In addition to the pressing by these two support rollers 158 and the tensions of the cooling belt 110 and the conveying belt 120, by means of further pressing of the press roller 151, close contact of the cooling belt 110 with the lower surface of the lower member 131*b* of the cooling plate 131 is assisted, and sheet conveying force and cooling effect are improved.

Pressing of the conveying belt 120 onto the lower surface of the lower member 131*b* of the cooling plate 131 through the cooling belt 110 in a state in which the cooling belt 110 and the conveying belt 120 are not driven is not preferable from the viewpoint of fixation between the cooling plate 131 and the cooling belt 110 and a load applied to the press roller 151. Therefore, as illustrated in FIG. 3, when an image is not to be formed on a sheet, the pressing base body 153 is moved downward by the pressing driving mechanism 152, the conveying belt 120 is not pressed onto the lower surface of the lower member 131*b* of the cooling plate 131, and the cooling belt 110 and the conveying belt 120 are separated from each other.

[Configuration of Control System of Image Forming Apparatus]

Subsequently, a control system of the image forming apparatus 1 will be described by referring to FIG. 5.

Figure 5:
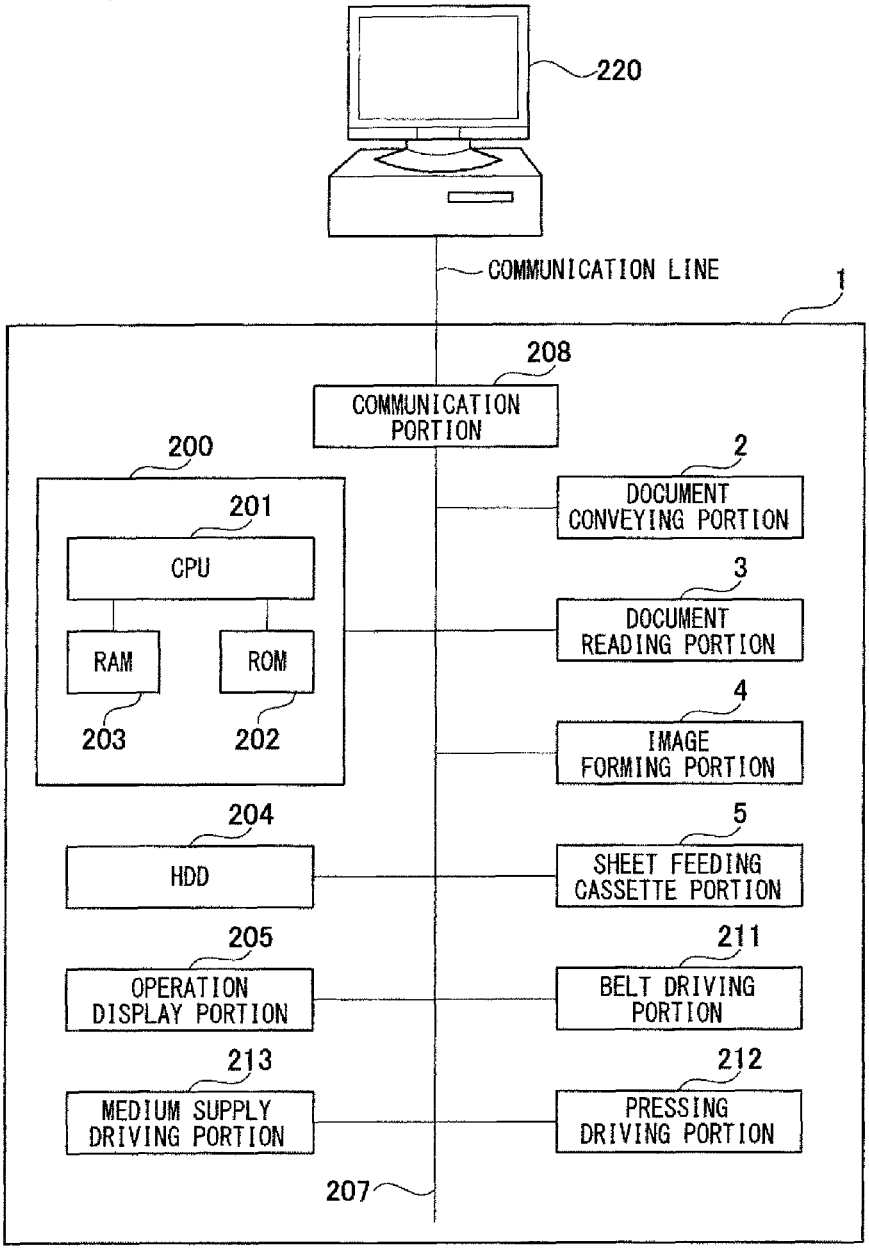
FIG. 5 is a block diagram illustrating a control system of the image forming apparatus in FIG. 1.

FIG. 5 is a block diagram illustrating the control system of the image forming apparatus 1.

As illustrated in FIG. 5, the image forming apparatus 1 includes the control portion 200. The control portion 200 is connected to an HDD 204, an operation display portion 205, a communication portion 208, the document conveying portion 2, the document reading portion 3, the image forming portion 4, and the sheet feeding cassette portion 5 through a system bus 207. Moreover, the control portion 200 is connected to a belt driving portion 211, a pressing driving portion 212, and a medium supply driving portion 213 through the system bus 207.

The control portion 200 has a CPU (Central Processing Unit) 201, a ROM (Read Only Memory) 202 for storing a program executed by the CPU 201 and the like, and a RAM (Random Access Memory) 203 used as a work area of the CPU 201, for example. As the ROM 202 (an example of a storage portion), an electrically erasable programmable ROM is used, for example. The control portion 200 executes control of each block, that is, control of the entire apparatus.

The HDD 204 stores image data of a document image obtained by reading by the document reading portion 3 and stores outputted image data and the like. The operation display portion 205 is a touch panel composed of display such as a liquid crystal display device (LCD), an organic ELD (Electro Luminescence Display) or the like. This operation display portion 205 displays an instruction menu to the user, information relating to the obtained image data and the like. Moreover, the operation display portion 205 is provided with a plurality of keys, receives an input of data such as various instructions, characters, numerals and the like by a key operation of the user and outputs an input signal to the control portion 200.

The communication portion 208 receives job information transmitted from a personal computer (PC) 220 which is an example of an external information processor through a communication line. Then, the communication portion 208 sends the received job information to the control portion 200 through the system bus 207.

The control portion 200 controls driving of the document conveying portion 2, the document reading portion 3, the image forming portion 4, and the sheet feeding cassette portion 5 on the basis of the job information.

The belt driving portion 211 is controlled by the control portion 200 and drives the cooling belt 110 of the cooling portion 130 and the conveying belt 120.

The pressing driving portion 212 is controlled by the control portion 200, drives the pressing driving mechanism 152, and presses the press roller 151 and the support rollers 158 which are supported by the pressing base body 153 onto the conveying belt 120 or stops pressing.

The medium supply driving portion 213 is controlled by the control portion 200 and drives the pump 141 so as to supply the cooling water from the tank 140 to the cooling pipe unit 132 so that the cooling water flows from the downstream side to the upstream side in the sheet conveying direction through the flow passage 137 in the cooling pipe unit 132.

In the present embodiment, the example in which the personal computer is applied as an external device is explained, but this is not limiting, and other various devices including a facsimile device and the like, for example, can be applied as the external device.

[Operation of Image Forming Apparatus]

An outline of an operation of the image forming apparatus 1 will be described below.

Figure 6:
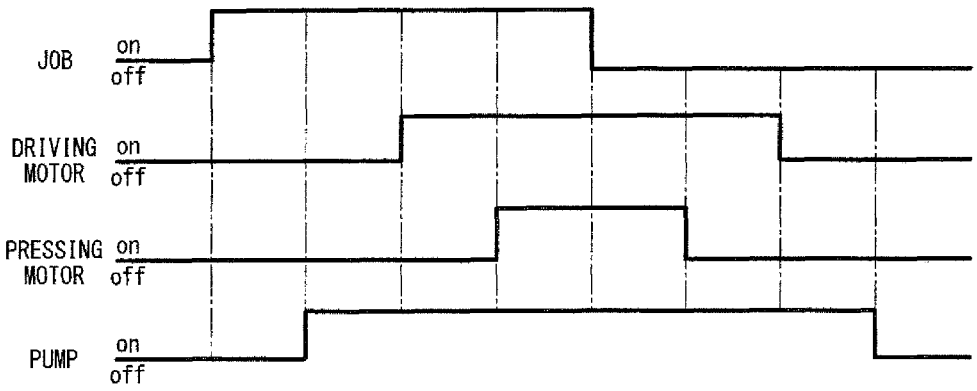
FIG. 6 is a timing chart for explaining a sequence at start and at end of the image forming apparatus in FIG. 1.

FIG. 6 is a timing chart for explaining a sequence at start and at end of the image forming apparatus 1.

(Sequence at Start)

First, the control portion 200 of the image forming apparatus 1, when detecting that job information has been inputted, controls the medium supply driving portion 213 after a job is started (job-on) so as to drive the pump 141 to circulate the cooling water through the flow passage 137 in the cooling pipe unit 132.

Subsequently, the control portion 200 controls the belt driving portion 211 so as to drive a belt driving motor, not shown, and drives the cooling belt 110 and the conveying belt 120.

Lastly, the control portion controls the pressing driving portion 212 so as to drive a pressing pump, not shown, constituting the pressing driving mechanism 152 and raises the pressing base body 153. Then, the support rollers 158 and the press rollers 151 supported by the pressing base body 153 are pressed onto the conveying belt 120, and the conveying belt 120 is pressed into contact with the cooling belt 110.

(Sequence at End)

First, the control portion 200 of the image forming apparatus 1 controls the pressing driving portion 212 after the job has ended (job-off) so as to drive the pressing pump constituting the pressing driving mechanism 152 to lower the pressing base body 153. Then, pressing by the support rollers 158 and the press rollers 151 is released, and the cooling plate 131 and the cooling belt 110 are separated from each other.

Subsequently, the control portion 200 controls the belt driving portion 211 so as to stop driving of the belt driving motor, not shown, to stop the cooling belt 110 and the conveying belt 120.

Lastly, the control portion 200 controls the medium supply driving portion 213 so as to stop driving of the pump 141 to stop supply of the cooling water to the flow passage 137 in the cooling pipe unit 132.

(Sequence at Jamming Processing)

Figure 7:
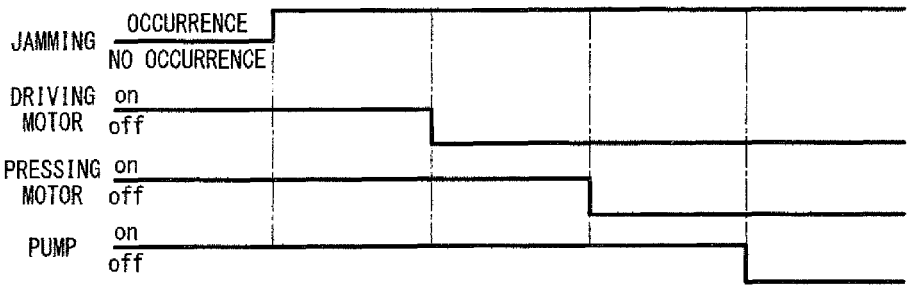
FIG. 7 is a timing chart for explaining a sequence during jamming processing of the image forming apparatus in FIG. 1.

FIG. 7 is a timing chart for explaining a sequence at jamming processing of the image forming apparatus 1.

The jamming refers to abnormal stop of a sheet in the image forming apparatus 1 due to some reason, and to remove the abnormally stopped sheet and sheets (remaining sheets) other than the jammed sheet stopped during conveying is referred to as jamming processing.

First, the control portion 200 of the image forming apparatus 1, when detecting occurrence of jamming, controls the belt driving portion 211 so as to stop driving of the belt driving motor, not shown, to stop the cooling belt 110 and the conveying belt 120.

Subsequently, the control portion 200 controls the pressing driving portion 212 so as to drive the pressing pump constituting the pressing driving mechanism 152 to lower the pressing base body 153. Then, the pressing by the support rollers 158 and the press rollers 151 is released, and the cooling plate 131 and the cooling belt 110 are separated from each other.

Lastly, the control portion 200 controls the medium supply driving portion 213 so as to stop driving of the pump 141 to stop supply of the cooling water to the flow passage 137 in the cooling pipe unit 132.

In the present embodiment configured as above, positions of the lower end portions of the stretching rollers (the upper driving roller 111 and the first upper driven roller 112) provided inside the cooling belt 110 are arranged so as to be located below the lower surface (cooling surface) of the cooling plate 131 of the cooling portion 130. As a result, the cooling belt 110 can be easily separated from the lower surface of the cooling plate 131 of the cooling portion 130. Thus, it is possible to prevent the cooling belt 110 from being unable to be driven, making wrinkles, and being broken due to fixation of the cooling belt 110 to the cooling surface of the cooling portion 130.

Moreover, by arranging the support rollers 158 on the upstream side and the downstream side of the press rollers 151 in the sheet conveying direction and on the outside of the lower surface of the lower member 131*b* of the cooling plate 131, the inner peripheral surface of the cooling belt 110 can be brought into contact with the whole lower surface of the cooling plate 131. Therefore, the whole lower surface of the cooling plate 131 can be used as the cooling surface, and cooling efficiency of the sheet is improved by utilizing cooling capacity of the cooling plate 131 to the maximum.

Moreover, by using a roller with high hardness for the support rollers 158, a distance from the upper surface of the pressing base body 153 to the upper end portions of support rollers 158 is kept constant. Thus, rattling of the belt caused by tension variation during belt driving when an elastic body is used can be prevented, and a stable contact state can be maintained between the cooling belt 110 and the conveying belt 120 all the time.

Moreover, by applying a uniform tension to the whole peripheral length of the cooling belt 110 during pressing by using a roller with a one-way clutch for the driving roller, a pressing load is not forcedly raised with respect to a specific roller during pressing, but a stable pressing load is applied all the time. Thus, a load on the second upper driven roller 115, the upper driving roller 111 and other support members can be reduced.

Moreover, in operations other than the image forming operation, by releasing pressing by the pressing unit 150, it is possible to prevent fixation between the cooling belt 110 and the cooling plate 131 caused by contact between the cooling belt 110 and the cooling plate 131 for a long time. Moreover, deformation of the press roller 151 can be prevented.

Moreover, in the sequence at start (at image formation) illustrated in FIG. 6, first, a temperature of the cooling plate 131 as a whole can be rapidly made constant, and a steering operation by the upper steering roller 114 and the lower steering roller 124 at start can be made stable in an early stage. At end, by rapidly separating the cooling belt 110 from the cooling plate 131, it is possible to reduce a burden on the cooling belt 110, make stable the temperature of the cooling plate 131 in the subsequent job, and keep uniformity between the jobs. Moreover, at occurrence of jamming, by immediately stopping the cooling belt 110 and the conveying belt 120, it is possible to reduce a burden and damage on the both belts.

Second Embodiment

Subsequently, a second embodiment of the present invention will be described by referring to FIGS. 8 to 14. Common members in each figure are given the same reference numerals. The second embodiment of the present invention relates to improvement of maintainability of each belt and each roller of the cooling device 100.

[Configuration of Cooling Device 100]

Figure 8:
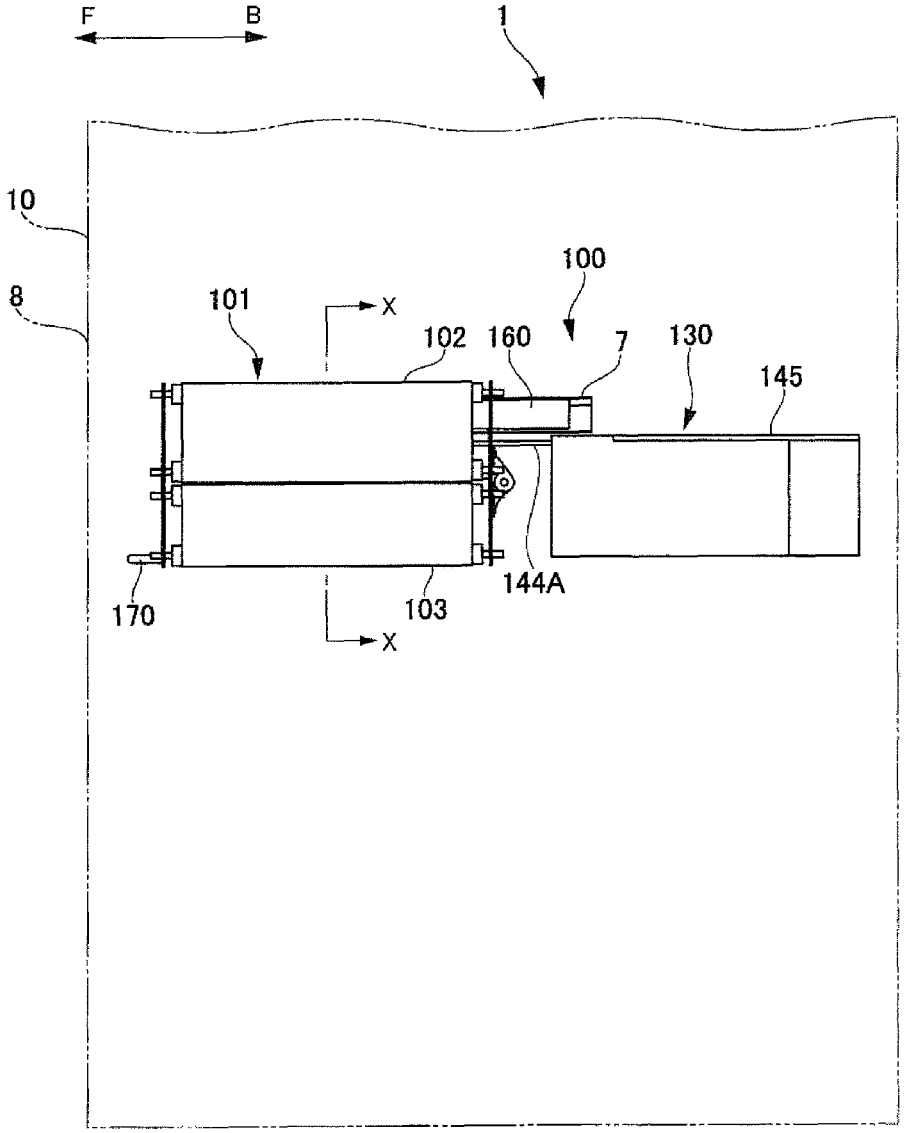
FIG. 8 is an explanatory diagram of the image forming apparatus according to a second embodiment of the present invention and a diagram of an essential part illustrating the image forming apparatus when seen from an arrow Y direction in FIG. 1.

By referring to FIG. 8, the cooling device 100 accommodated in a housing 8 of an image forming apparatus body 10 will be described. FIG. 8 is a diagram of an essential part illustrating the image forming apparatus 1 seen from an arrow Y direction in FIG. 1.

As illustrated in FIG. 8, the cooling device 100 includes a conveying portion 101 and the cooling portion 130. In the present embodiment, the cooling device 100 is arranged between the fixation portion 48 and the sheet ejection roller 49 (see FIG. 1). Moreover, the conveying portion 101 of the cooling device 100 is supported by a cooling device support portion 7 which will be described later of the image forming apparatus body 10 capable of being inserted/removed in two directions (an arrow F direction and an arrow B direction in the figure) perpendicular to the sheet conveying direction of the image forming apparatus 1. That is, the cooling device 100 accommodated in the image forming apparatus body 10 can be pulled out to the front (F direction) of the image forming apparatus 1 and the pulled-out cooling device 100 can be moved to the rear (B direction) of the image forming apparatus 1 and can be inserted into the image forming apparatus body 10.

The conveying portion 101 conveys the sheet along the conveying path A (see FIG. 1), and the cooling portion 130 cools the sheet being conveyed.

[Configuration of Conveying Portion 101]

Figure 9:
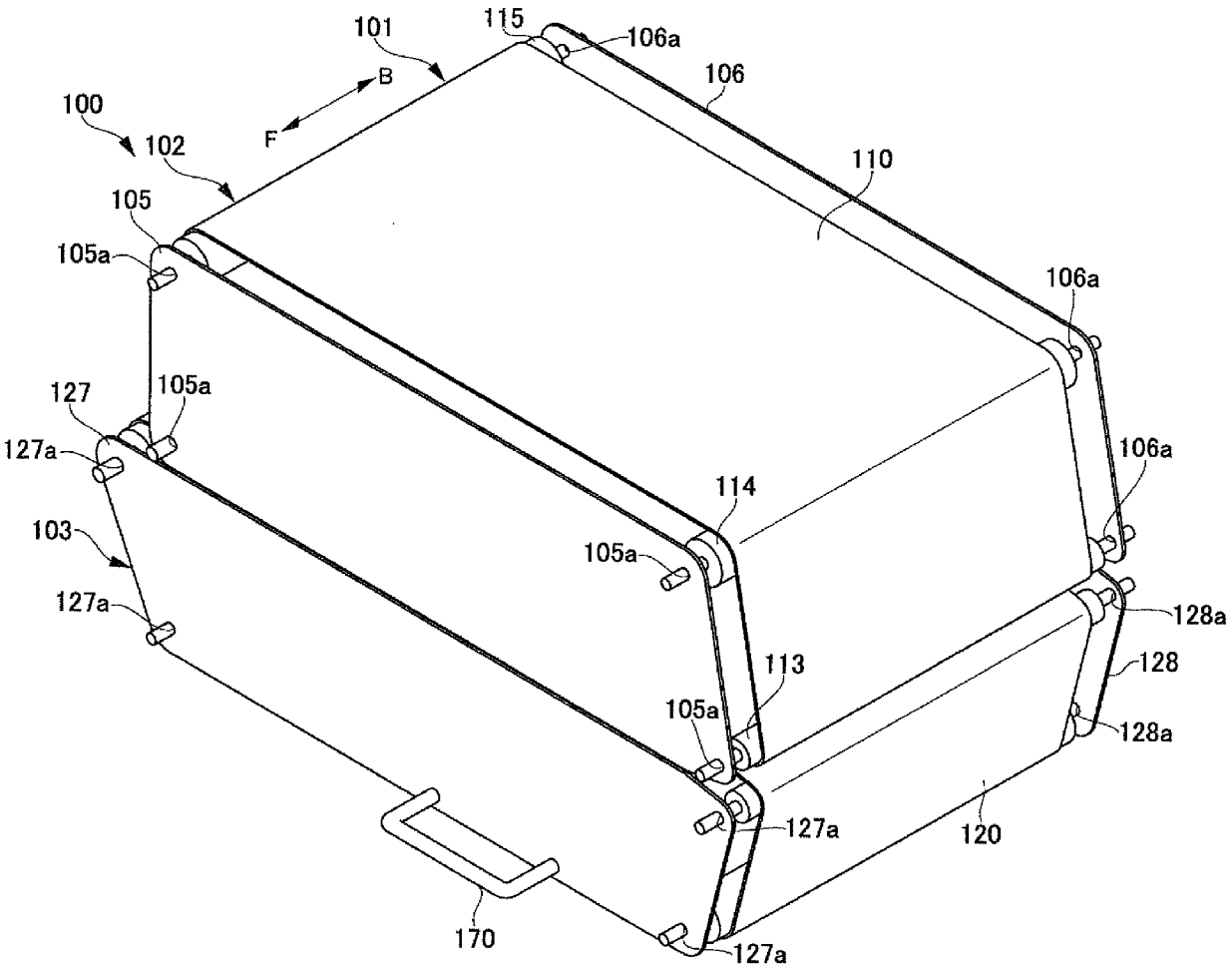
FIG. 9 is a perspective view of the essential part illustrating the cooling device of the image forming apparatus in FIG. 8 when seen from front diagonally above.
Figure 10:
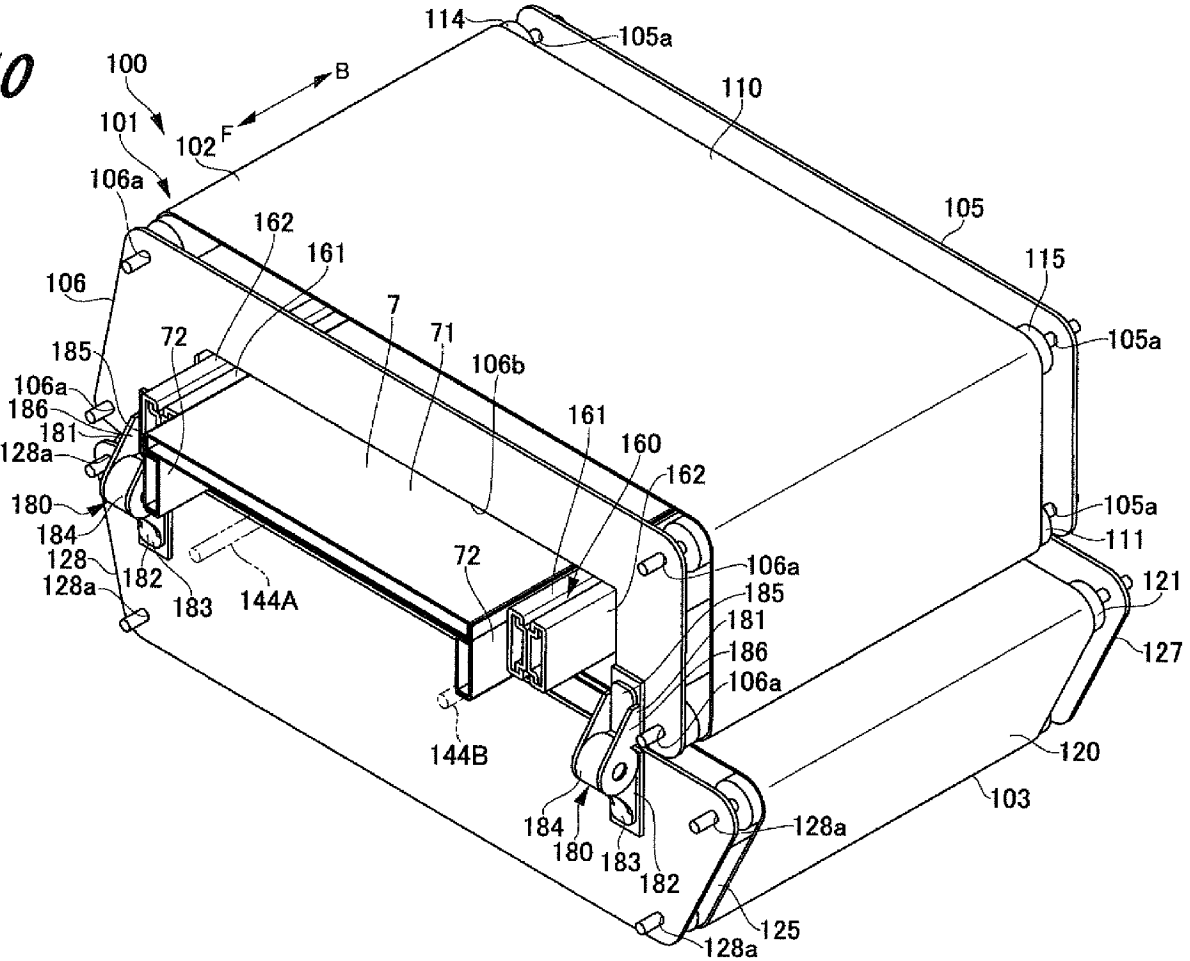
FIG. 10 is a perspective view of the essential part illustrating the cooling device of the image forming apparatus in FIG. 8 when seen from rear diagonally above.
Figure 11:
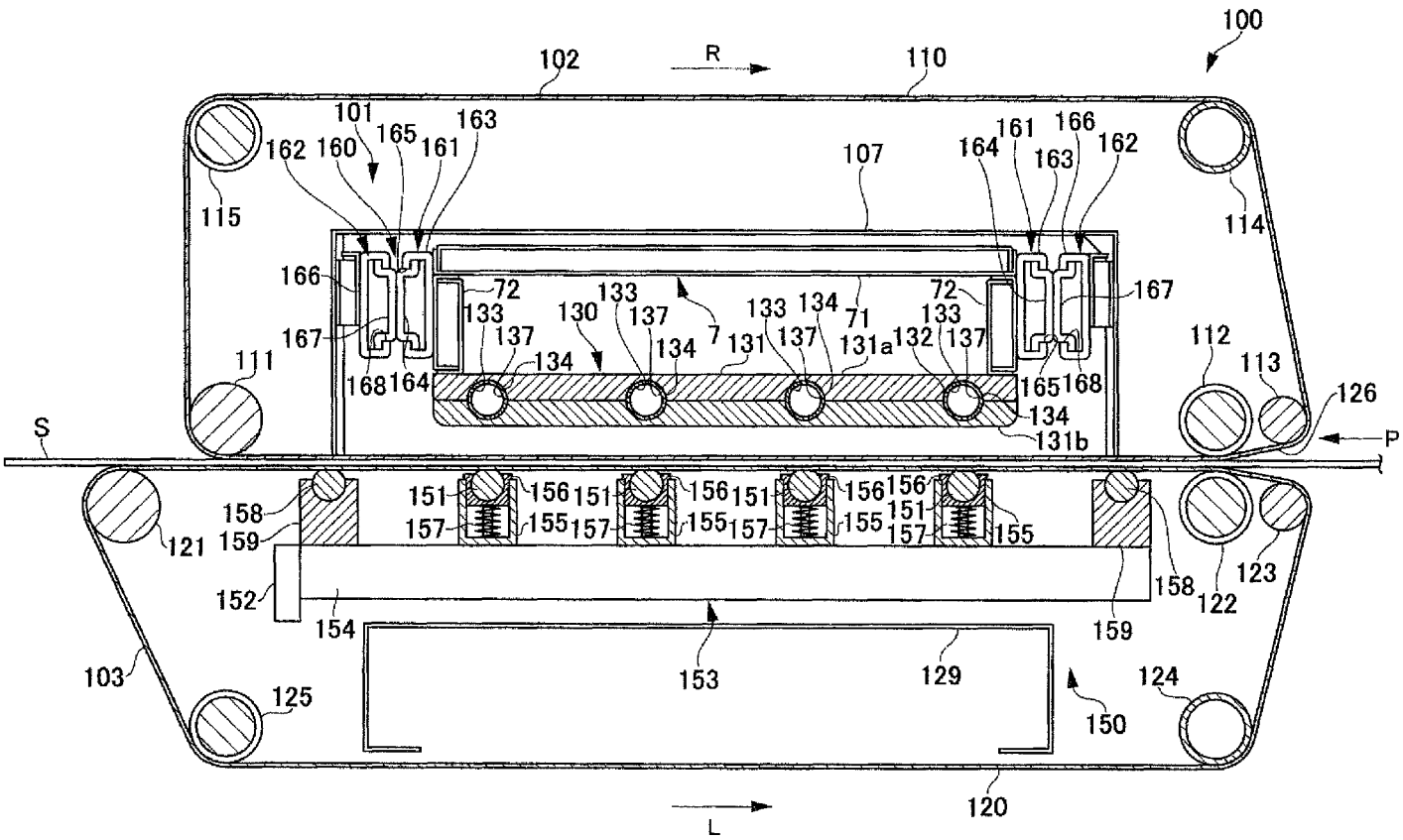
FIG. 11 is an arrow sectional view on an X-X line of the cooling device of the image forming apparatus in FIG. 8.

Subsequently, by referring to FIGS. 9 to 11, the conveying portion 101 of the cooling device 100 will be described. FIG. 9 is a perspective view of an essential part of the cooling device 100 seen from front diagonally above. FIG. 10 is a perspective view of the essential part of the cooling device 100 when seen from rear diagonally above. FIG. 11 is a sectional view of an X-X line arrow of the cooling device 100 of the image forming apparatus 1 in FIG. 8. In FIGS. 9 and 10, illustration of the cooling portion 130 is omitted.

As illustrated in FIGS. 9 to 11, the conveying portion 101 has a cooling belt unit (first belt unit) 102, a unit moving mechanism (see FIG. 11) 160, a conveying belt unit (second belt unit) 103, a hinge portion 180 (see FIG. 10), and the pressing unit 150 (see FIG. 11).

[Configuration of Cooling Belt Unit 102]

The cooling belt unit 102 has the cooling belt (first belt) 110, a plurality of rollers across which the cooling belt 110 stretches, a front upper plate portion 105 and a rear upper plate portion 106 pivotally supporting the plurality of rollers rotatably, and an upper joining portion (see FIG. 11) 107 for joining the front upper plate portion 105 and the rear upper plate portion 106.

As illustrated in FIG. 9, the front upper plate portion 105 is a rectangular flat plate-shaped member provided on a front upper side of the conveying portion 101. In the vicinity of each corner part of the front upper plate portion 105, a plurality of bearing holes 105*a* penetrating in the longitudinal direction is provided.

As illustrated in FIG. 10, the rear upper plate portion 106 is a rectangular flat plate-shaped member provided on a rear upper side of the conveying portion 101. The rear upper plate portion 106 faces the front upper plate portion 105. In the vicinity of each corner part of the rear upper plate portion 106, a plurality of bearing holes 106*a* penetrating in the longitudinal direction is provided. At the substantially center part of the rear upper plate portion 106, the cooling device support portion 7 which will be described later and a support portion insertion hole 106*b* through which the cooling plate 131 fixed to the cooling device support portion 7 is inserted are provided.

As illustrated in FIG. 11, the upper joining portion 107 is a substantially square cylindrical member. On a lower part of the upper joining portion 107, the cooling device support portion 7 which will be described later and an opening through which the cooling plate 131 fixed to the cooling device support portion 7 is inserted are provided. One end portion of the upper joining portion 107 is fixed to the housing 8 of the image forming apparatus body 10 or a member fixedly installed on the housing 8.

As described above, in the present embodiment, the rollers across which the cooling belt 110 stretches, that is, the first rollers are the upper driving roller 111, the first upper driven roller 112, the upper introduction roller 113, the upper steering roller 114, and the second upper driven roller 115. By inserting a rotating shaft of each of the rollers 111, 112, 113, 114, and 115 into the bearing holes 105*a* and 106*a* of the front upper plate portion 105 and the rear upper plate portion 106, each of the rollers 111, 112, 113, 114, and 115 is pivotally supported by the front upper plate portion 105 and the rear upper plate portion 106 rotatably.

[Configuration of Unit Moving Mechanism 160]

The unit moving mechanism 160 is, as illustrated in FIG. 11, constituted by two sets of first slide portion 161 and second slide portion 162 and is fixed to the upper joining portion 107 and the cooling device support portion 7 provided on the image forming apparatus body 10.

The cooling device support portion 7 includes a substantially flat plate-shaped flat plate portion 71 and two substantially prismatic columnar prism portions 72. The flat plate portion 71 and the prism portions 72 are formed by welding two members formed by bending a metal flat plate at bent spots. The prism portions 72 are welded/fixed in the perpendicular direction to both end portions of the flat plate portion 71. On the other end portion of the prism portion 72, an end portion in one direction of the upper member 131*a* of the cooling plate 131 is fixed.

A front part of the cooling device support portion 7 is inserted through the support portion insertion hole 106*b* and is disposed in the cooling belt unit 102 (see FIG. 10).

As illustrated in FIG. 11, the first slide portion 161 of the unit moving mechanism 160 includes a first outer slide portion 163 and a first inner slide portion 164. The first outer slide portion 163 is a substantially square cylindrical member and is arranged so that one side surface thereof faces the prism portion 72 of the cooling device support portion 7. On a side surface facing the one side surface of the first outer slide portion 163, a long hole 165 is formed.

The first inner slide portion 164 is formed by bending a substantially flat plate-shaped metal plate. Engagement of a bent spot of the first inner slide portion 164 with the long hole 165 of the first outer slide portion 163 makes the first inner slide portion 164 and the first outer slide portion 163 engaged with each other relatively slidably in a longitudinal direction (insertion/removal direction of the conveying portion 101) of the image forming apparatus 1.

On both end portions of the first outer slide portion 163 in a sliding direction, a stopper (not shown) to be engaged with the first inner slide portion 164 and to regulate a sliding range of the first outer slide portion 163 and the first inner slide portion 164 is provided.

The second slide portion 162 includes a second outer slide portion 166 and a second inner slide portion 167. The second outer slide portion 166 is formed into a shape similar to that of the first outer slide portion 163, and the second inner slide portion 167 is formed into a shape similar to that of the first inner slide portion 164. One side surface of the second outer slide portion 166 is fixed to the upper joining portion 107 incapable of relative movement. Engagement of a bent spot of the second inner slide portion 167 with a long hole 168 of the second outer slide portion 166 makes the second inner slide portion 167 and the second outer slide portion 166 engaged with each other relatively slidably in the longitudinal direction of the image forming apparatus 1.

Figure 13:
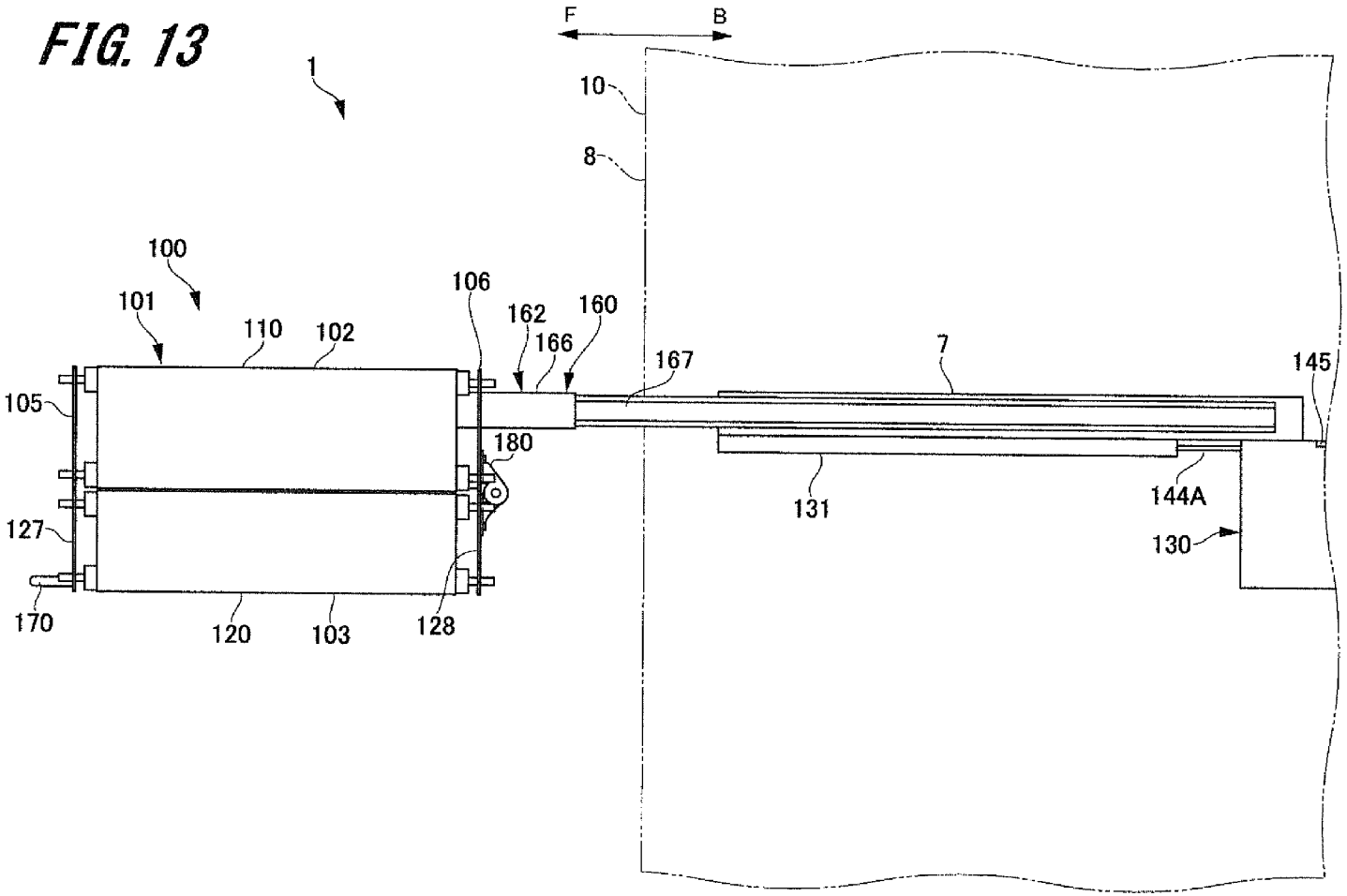
FIG. 13 is a diagram for explaining an action of the image forming apparatus in FIG. 8 and an explanatory diagram illustrating a state in which the cooling device is pulled out of a housing of a main body of the image forming apparatus.

The second inner slide portion 167 and the first inner slide portion 164 are fixed incapable of relative movement. Moreover, an end portion on a side opposite to the conveying portion 101 of the second inner slide portion 167 is, as illustrated in FIG. 13 which will be described later, extended to a rear surface or the vicinity of the rear surface of the housing 8 of the image forming apparatus body 10.

By moving forward the cooling belt unit 102 configured as above and accommodated in the housing 8 of the image forming apparatus body 10, the second outer slide portion 166 slides forward with respect to the second inner slide portion 167. After the stopper of the second outer slide portion 166 is engaged with the second inner slide portion 167, by further moving the cooling belt unit 102 forward, the first inner slide portion 164 fixed to the second inner slide portion 167 incapable of relative movement slides forward with respect to the first outer slide portion 163. That is, the first slide portion 161 and the second slide portion 162 extend, and the cooling belt unit 102 moves forward. At this time, the cooling plate 131 does not move but remains at the same position in the housing 8.

Moreover, by moving the cooling belt unit 102 having moved forward to the rear as above, the second outer slide portion 166 slides rearward with respect to the second inner slide portion 167. After the stopper of the second outer slide portion 166 is engaged with the second inner slide portion 167, by further moving the cooling belt unit 102 rearward, the first inner slide portion 164 fixed incapable of relative movement to the second inner slide portion 167 slides rearward with respect to the first outer slide portion 163. That is, the first slide portion 161 and the second slide portion 162 contract, and the cooling belt unit 102 moves rearward.

[Configuration of Conveying Belt Unit 103]

As illustrated in FIGS. 9 to 11, the conveying belt unit (second belt) 103 is provided below the cooling belt unit 102. The conveying belt unit 103 has the conveying belt 120, a plurality of rollers across which the conveying belt 120 stretches, a front lower plate portion 127 and a rear lower plate portion 128 pivotally supporting the plurality of rollers rotatably and a lower joining portion 129 joining the front lower plate portion 127 and the rear lower plate portion 128 (see FIG. 11).

As illustrated in FIG. 9, the front lower plate portion 127 is a rectangular flat plate-shaped member provided on a front lower side of the conveying portion 101. In the vicinity of each corner part of the front lower plate portion 127, a bearing hole 127*a* penetrating in the longitudinal direction is provided. At a lower part of the front lower plate portion 127, a handle portion 170 used when a worker withdraws the cooling device 100 from the image forming apparatus body 10 is provided.

As illustrated in FIG. 10, the rear lower plate portion 128 is a rectangular flat plate-shaped member provided on a rear lower side of the conveying portion 101. The rear lower plate portion 128 faces the front lower plate portion 127. In the vicinity of each corner part of the rear lower plate portion 128, a bearing hole 128*a* penetrating in the longitudinal direction is provided.

As illustrated in FIG. 11, the lower joining portion 129 is a substantially square cylindrical member. On a lower part of the lower joining portion 129, an opening is provided. Both end portions of the image forming apparatus 1 in the longitudinal direction in the lower joining portion 129 are fixed to the front lower plate portion 127 and the rear lower plate portion 128.

As described above, in the present embodiment, the rollers across which the conveying belt 120 stretches, that is, the second rollers are the lower driving roller 121, the first lower driven roller 122, the lower introduction roller 123, the lower steering roller 124, and the second lower driven roller 125. By inserting a rotating shaft of each of the rollers 121, 122, 123, 124, and 125 in the bearing holes 127*a* and 128*a* of the front lower plate portion 127 and the rear lower plate portion 128, each of the rollers 121, 122, 123, 124, and 125 is pivotally supported by the front lower plate portion 127 and the rear lower plate portion 128 rotatably.

[Configuration of Hinge Portion 180]

The hinge portion 180 is provided on a rear part of the cooling device 100, as illustrated in FIG. 10, at two positions not interfering with the cooling device support portion 7 and the cooling plate 131.

Each of the hinge portions 180 has an upper hinge portion 181, a lower hinge portion 182, and a coil spring (not shown). The lower hinge portion 182 has a substantially flat plate-shaped lower joining surface portion 183 and a cylindrical shaft portion 184 integrally formed on an upper end portion of the lower joining surface portion 183. The lower joining surface portion 183 is fixed to an upper end portion of the rear lower plate portion 128 of the conveying belt unit 103.

The upper hinge portion 181 has a substantially flat plate-shaped upper joining surface portion 185 and a pair of bearing portions 186 integrally formed on the upper joining surface portion 185. The upper joining surface portion 185 is fixed to a lower end portion of the rear upper plate portion 106 of the cooling belt unit 102. The pair of bearing portions 186 pivotally support the shaft portion 184 of the lower hinge portion 182 rotatably. Therefore, the hinge portions 180 connect the conveying belt unit 103 to the cooling belt unit 102 rotatably around the shaft portion 184.

The coil spring is provided in the vicinity of the shaft portion 184 and the bearing portion 186 and urges the conveying belt unit 103 in a direction to contract a distance between the conveying belt unit 103 and the cooling belt unit 102.

[Configuration of Cooling Portion 130]

Subsequently, by referring to FIGS. 11 and 12, the cooling portion 130 of the cooling device 100 will be described. FIG. 12 is a top view of the essential part of the cooling device 100 seen from above. The arrow F in FIG. 12 indicates the front of the image forming apparatus 1 and the arrow B indicates the rear of the image forming apparatus 1. Moreover, in FIG. 12, illustration of the conveying portion 101 is omitted.

Figure 12:
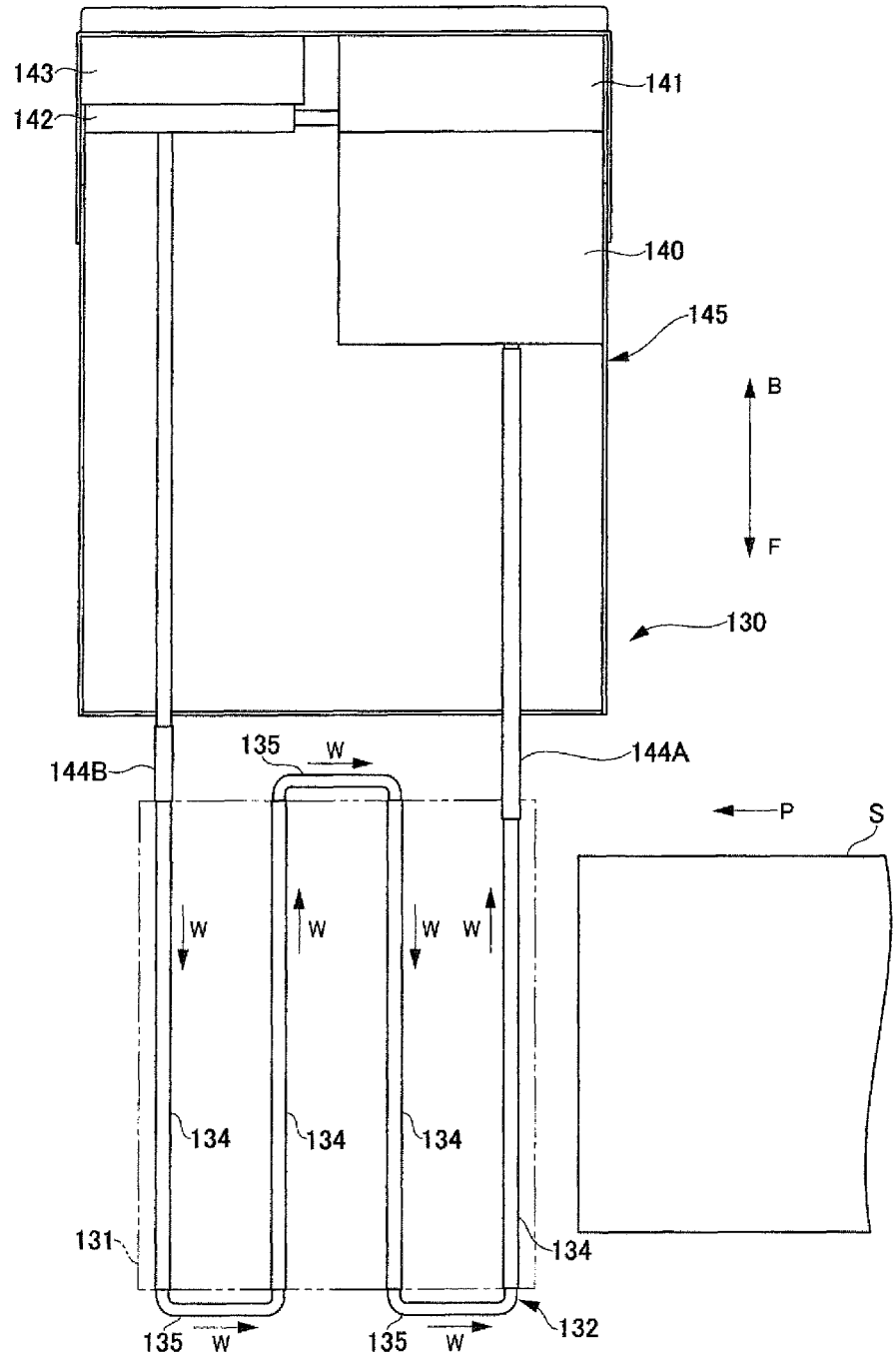
FIG. 12 is a top view of the essential part of the cooling device of the image forming apparatus in FIG. 11 when seen from above.

The cooling portion 130 has the cooling plate 131 and the cooling pipe unit (flow-passage forming portion) 132 illustrated in FIG. 11, pipes 144A and 144B illustrated in FIG. 12, the tank 140, the pump (medium supply portion) 141, the radiator 142, the fan 143, and an accommodating portion 145.

To the cooling pipe body 134 arranged on the uppermost stream side in the sheet conveying direction, the cylindrical pipe 144A connecting this cooling pipe body 134 to the tank 140 is connected. Moreover, to the cooling pipe body 134 arranged on the lowermost stream side in the sheet conveying direction, the cylindrical pipe 144B connecting the cooling pipe body 134 to the radiator 142 is connected.

The accommodating portion 145 is a member formed into a substantially box shape as illustrated in FIG. 12 and accommodates the tank 140, the pump 141, the radiator 142, and the fan 143 therein. A front surface of the accommodating portion 145 is open, and the pipes 144A and 144B are inserted therethrough. One side surface of the accommodating portion 145 is fixed to the rear surface of the housing 8.

[Action of Image Forming Apparatus 1]

Figure 14:
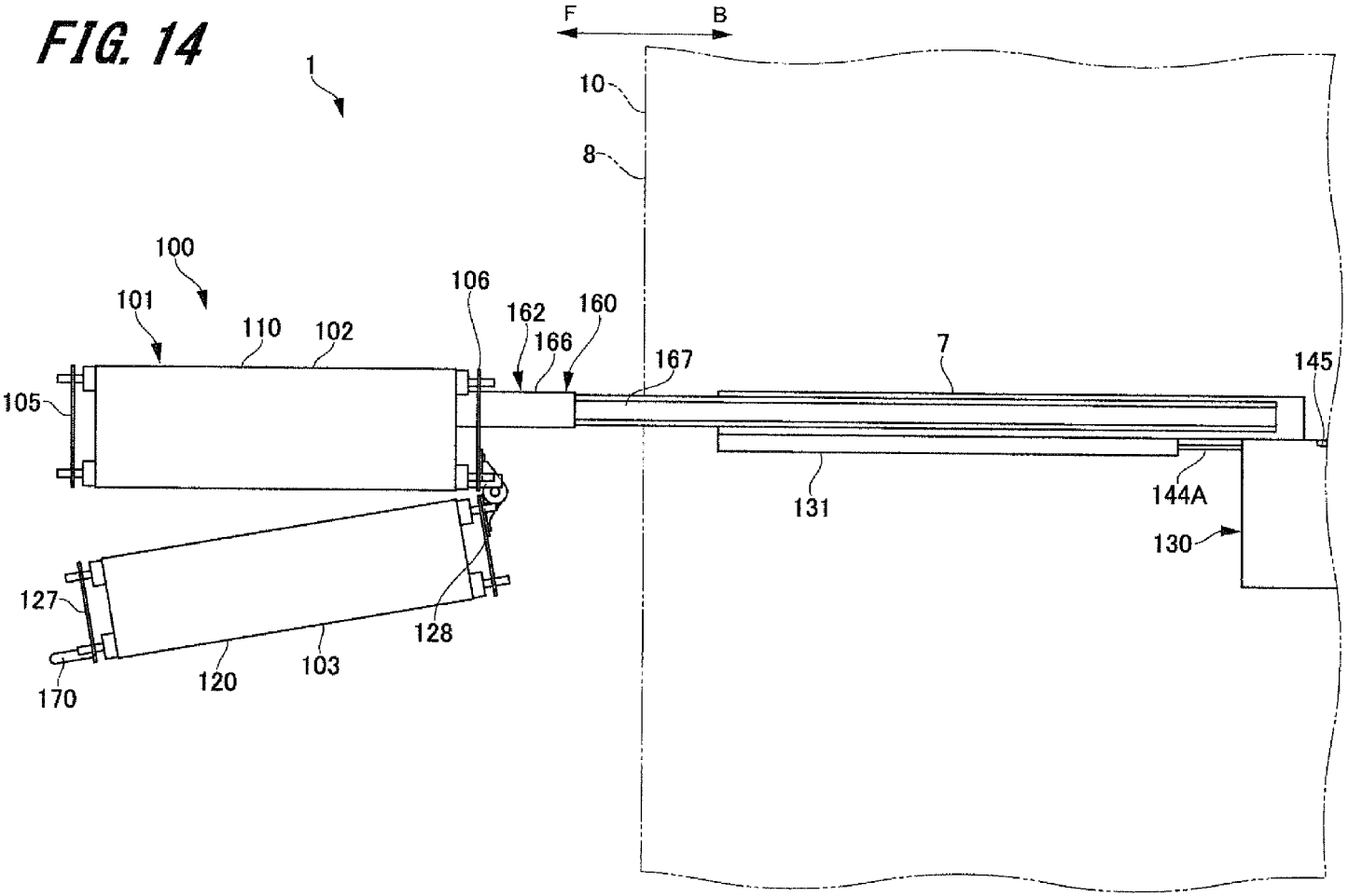
FIG. 14 is a diagram for explaining an action of the image forming apparatus in FIG. 8 and an explanatory diagram illustrating a state in which a conveying belt unit of the cooling device is opened.

Subsequently, by referring to FIGS. 13 and 14, an action of the image forming apparatus 1 of the present embodiment will be described. FIG. 13 is a diagram for explaining the action of the image forming apparatus 1 and an explanatory diagram illustrating a state in which the cooling device 100 has been withdrawn from the housing 8 of the image forming apparatus body 10. FIG. 14 is a diagram for explaining the action of the image forming apparatus 1 and an explanatory diagram illustrating a state in which the conveying belt unit 103 of the cooling device 100 is opened. In FIGS. 13 and 14, the arrow F indicates the front of the image forming apparatus 1 and the arrow B indicates the rear of the image forming apparatus 1.

As illustrated in FIG. 13, if the cooling device 100 accommodated in the image forming apparatus body 10 is to be withdrawn to the front of the image forming apparatus 1, the worker grips the handle portion 170 of the conveying belt unit 103 and moves the cooling device to the front.

At this time, the first slide portion 161 and the second slide portion 162 of the unit moving mechanism 160 in the cooling belt unit 102 connected to the conveying belt unit 103 by the hinge portion 180 extend, and the cooling belt unit 102 moves to the front.

As described above, the cooling belt unit 102, the cooling device support portion 7, and the cooling plate 131 have a separable structure. Therefore, even if the cooling belt unit 102 moves to the front, the accommodating portion 145 accommodating the tank 140, the pump 141, the radiator 142, and the fan 143 remains at the spot and is left in the image forming apparatus 1. That is, in the image forming apparatus 1, only the conveying portion 101 moves without movement of the cooling portion 130.

Subsequently, the action of the image forming apparatus 1 when, as illustrated in FIG. 14, a front part of the conveying belt unit 103 of the withdrawn cooling device 100 is lowered, and the conveying belt unit 103 is opened with respect to the cooling belt unit 102 will be described.

When the conveying belt unit 103 is to be opened, the worker grips the handle portion 170 and lowers the front part of the conveying belt unit 103 and then, the conveying belt unit 103 rotates around the shaft portion 184 of the hinge portion 180 (see FIG. 10). The front part of the cooling belt unit 102 and the front part of the conveying belt unit 103 are separated from each other, and a space portion into which a user can put the hand is formed to a depth side in main scanning directions of the cooling belt 110 and the conveying belt 120.

Moreover, if the front part of the conveying belt unit 103 is raised from the state illustrated in FIG. 14, the conveying belt unit 103 rotates around the shaft portion 184 (see FIG. 10), and the space portion formed between the cooling belt unit 102 and the conveying belt unit 103 is closed.

In the present embodiment configured as above, the cooling belt unit 102 can be withdrawn from the image forming apparatus body 10 while the cooling portion 130 is left in the image forming apparatus body 10. Moreover, after the withdrawal, the space portions can be formed between the cooling belt unit 102 and the conveying belt unit 103 by gripping and lowering the handle portion 170. The user can perform a work such as replacement of the belt by using this space portion. Then, after the handle portion 170 is gripped and raised so as to close the space portion formed between the cooling belt unit 102 and the conveying belt unit 103, the withdrawn cooling belt unit 102 can be inserted into the image forming apparatus body 10. Therefore, when the cooling belt 110, the conveying belt 120, and each roller are to be replaced, the cooling portion 130 can be left in the image forming apparatus body 10 and does not have to be moved. Thus, water leakage from the cooling plate 131 or the pipe 144A or 144B can be prevented, and workability in replacement of each component is drastically improved.

The embodiments to which the present invention is applied have been described as above. However, the present invention is not limited by description and drawings constituting a part of disclosure of the invention by the above described embodiments and is capable of various variations within a range not departing from the gist of the invention described in the appended claims.

Moreover, the mode in which the cooling device 100 is provided in the image forming apparatus 1 has been described, but the cooling device 100 may be provided outside the image forming apparatus 1, and the image forming apparatus 1 and the cooling device 100 may be connected for use. In this case, a control portion including a processing portion composed of a CPU and the like and a storage portion composed of an ROM, an RAM and the like may be provided in the cooling device 100, and this control portion may be configured to perform processing such as driving processing of the pump 141.

Moreover, the present invention may be applied to an image forming apparatus forming a color image.

What is claimed is:

1. A cooling device used for an image forming apparatus, comprising:

a conveying portion having a first belt and a second belt which are endless and face each other, and configured to convey a sheet while holding the sheet between the first belt and the second belt;

a stretching roller provided inside the first belt and configured to drive the first belt;

a cooling portion having a flow-passage forming portion for forming a flow passage through which a cooling medium flows and configured to cool the sheet through the first belt;

a press roller provided inside the second belt and facing the flow-passage forming portion through the second belt and the first belt; and a contacting/separating portion configured to have the second belt contact with/separate from the cooling portion through the first belt by moving the press roller, wherein the stretching roller is arranged so that a tangent on a lower side among tangents of a sectional shape in a horizontal direction is located below a cooling surface contacting with the first belt of the cooling portion.

2. The cooling device according to claim 1, further comprising:

a support roller configured to support the second belt, and arranged outside the cooling surface of the cooling portion on an upstream side and a downstream side of the press roller in a sheet conveying direction so that a tangent on an upper side among the tangents of the sectional shape in the horizontal direction has substantially the same height as a contact portion between the press roller and the second belt.

3. The cooling device according to claim 2, wherein the support roller is constituted by a member having a high hardness, and a distance from an upper surface of the contacting/separating portion on which the support roller is arranged to the tangent on an upper side among the tangents of the sectional shape of the support roller in the horizontal direction is constant.

4. The cooling device according to claim 1, wherein the press roller is formed of an elastic body capable of elastic deformation.

5. The cooling device according to claim 1, wherein the stretching roller is a roller for transmitting only a rotation torque in a sheet conveying direction on a downstream side in the sheet conveying direction from a region where the first belt is in contact with the sheet.

6. The cooling device according to claim 1, wherein when the image forming apparatus starts a job for forming an image on a sheet, the cooling portion performs flow of a cooling medium through a flow passage of the flow-passage forming portion and subsequently, the conveying portion drives the first belt and the second belt, and subsequently, the press roller presses the second belt onto the cooling surface of the cooling portion through the first belt.

7. The cooling device according to claim 1, wherein when the image forming apparatus ends a job for forming an image on a sheet, the press roller stops an operation of pressing the second belt onto the cooling surface of the cooling portion through the first belt, and subsequently, the cooling portion stops flow of a cooling medium to the flow passage of the flow-passage forming portion, and subsequently, the conveying portion stops driving of the first belt and the second belt.

8. The cooling device according to claim 1, wherein if jamming of a sheet occurs inside the image forming apparatus, the conveying portion stops driving of the first belt and the second belt, and subsequently, the press roller stops an operation of pressing the second belt onto the cooling surface of the cooling portion through the first belt, and subsequently, the cooling portion stops flow of a cooling medium to the flow passage of the flow-passage forming portion.

9. An image forming apparatus comprising an image forming portion for forming an image on a sheet and a cooling device for cooling the sheet, wherein the cooling device includes:

a conveying portion having a first belt and a second belt which are endless and face each other, and configured to convey a sheet while holding the same between the first belt and the second belt;

a stretching roller provided inside the first belt and configured to drive the first belt;

a cooling portion having a flow-passage forming portion for forming a flow passage through which a cooling medium flows and configured to cool the sheet through the first belt;

a press roller provided inside the second belt and facing the flow-passage forming portion through the second belt and the first belt; and a contacting/separating portion configured to have the second belt contact with/separate from the cooling portion through the first belt by moving the press roller, and wherein the stretching roller is arranged so that a tangent on a lower side among tangents of a sectional shape in a horizontal direction is located below a cooling surface contacting with the first belt of the cooling portion.

* * * * *